US005667040A

United States Patent [19]

Samulak et al.

[11] Patent Number: 5,667,040

[45] Date of Patent: Sep. 16, 1997

[54] METHOD FOR CHANGING A PACKING CUP ON A BRAKE ACTUATION-SLACK ADJUSTER

[75] Inventors: Zdzislaw Samulak, Watertown; Lyle Jantzi, Adams, both of N.Y.

[73] Assignee: New York Air Brake Corporation, Watertown, N.Y.

[21] Appl. No.: 571,197

[22] Filed: Dec. 12, 1995

[51] Int. Cl.[6] ..... B61H 13/00; F16J 9/00; B23P 6/00

[52] U.S. Cl. ..... 188/52; 188/197; 29/402.02; 29/402.08; 29/888.021; 29/888.041; 29/888.3; 277/9; 277/9.5

[58] Field of Search ..... 188/202, 203, 188/52, 196 R, 197–199, 196 P, 196 D, 196 V, 53–54, 207, 219.1, 217, 220.1; 29/402.02, 402.03, 402.08, 888.021, 888.041, 888.07, 888.3; 277/9, 9.5, 212 C

[56] References Cited

U.S. PATENT DOCUMENTS

| | | | |
|---|---|---|---|
| 2,845,130 | 7/1958 | Austin | 277/9.5 |
| 3,036,639 | 5/1962 | Baker | 277/9.5 X |
| 3,499,507 | 3/1970 | Scott et al. | 188/52 |
| 4,793,446 | 12/1988 | Hart et al. | 188/52 |
| 5,400,874 | 3/1995 | Gayfer et al. | 188/52 |
| 5,495,921 | 3/1996 | Samulak et al. | 188/202 |

*Primary Examiner*—Peter M. Poon
*Attorney, Agent, or Firm*—Barnes & Thornburg

[57] ABSTRACT

The method includes moving a piston and a force transmitting element connected to the piston to a locking position. The piston and force transmission elements are locked in the locking position which preferably is displaced from the brake released position. Preferably, the piston is locked to the housing and the force transmission elements to a brake beam. A portion of the cylinder surrounding the piston is removed from the housing which is connected to the brake beam or truck and the packing cup is replaced. The cylinder portion is then replaced on the housing and the piston and the force transmission elements are unlocked and the piston and the force transmission elements are allowed to return to their released position.

21 Claims, 3 Drawing Sheets

METHOD FOR CHANGING A PACKING CUP ON A BRAKE ACTUATION-SLACK ADJUSTER

BACKGROUND AND SUMMARY OF THE INVENTION

The present invention relates to truck-mounted brakes for a railroad vehicle and more particularly to an improved method of replacing packing cups on a single actuator-slack adjuster while mounted to truck mounted brakes.

The accepted truck mounted brakes throughout the railroad industry approved by AAR is a double actuator system known as NYCOPAC sold by New York Air Brake Corporation and its equivalent WABCOPAC sold by Westinghouse Air Brake Corporation. Two actuators are used, one connected to each brake beam on opposite sides of the center axis. An example of the structure is illustrated in U.S. Pat. No. 3,499,507. The next generation of truck mounted brake includes a single actuator, truck mounted brake assembly known as NYCOPAC II and WABCOPAC II. This structure includes a single actuator with a pair of force transmitting arms and a lever connected to the opposite brake beam. A typical example of this structure is illustrated in U.S. Pat. No. 4,793,446.

As illustrated in U.S. Pat. No. 3,499,507, the slack adjuster is provided on the opposite end of the force transmitting device from the actuator and in the opposing brake beam. The NYCOPAC and WABCOPAC have no slack adjuster. In the single actuator system illustrated in U.S. Pat. No. 4,793,446 the slack adjuster is on the return force transmitting device. It is important that the force transmitting elements and the slack adjuster do not intersect the openings in the bolster for the various angular positions of the force transmitting elements.

The single actuator, truck mounted brake provides a force generated by the brake cylinder multiplied by a factor of four. This system is very effective as a force generated by the brake cylinder is transferred to the center of the arc of each of the shoes equally. The center of the force in the middle of each of the shoes eliminates wasted torsional components that exist in other systems.

The NYCOPAC II including a double acting slack adjuster brake cylinder having air on one side of the piston to apply the brakes and a spring return. The hand brake is connected to the piston directly by a series of cables, rods and chains. Since the hand brake worked directly on the piston, the slack adjuster operated the same when actuated by air as well as the hand operated brakes. In a single actuator system illustrated in U.S. Pat. No. 4,793,446, wherein the slack adjuster is in the return force transmitting element or device, the hand brake has been applied at the output of the actuator prior to the slack adjuster. This structure, as illustrated in U.S. Pat. Nos. 4,771,686 and 5,069,312, applies a single force in a common direction to the slack adjuster and thus is similar to operation to the NYCOPAC II without the use of cables or connection to the piston itself, internal the brake cylinder.

When one attempts to incorporate a hand brake connected to the output of the actuator where the actuator includes the slack adjuster thereby eliminating the cables from the NYCOPAC II, dangerous situations may be produced. The pulling forces produced by the hand brake are substantially larger than the pushing force produced by the pneumatic actuated piston. This could detrimentally affect and possibly destroy the slack adjuster. Also, if the actuator is not operated by air after replacement of brakes, the elements within the slack adjustor are not in their appropriate position and an application of the hand brake would not produce a slack adjusting operation. Thus, either the hand brake will not apply the brakes in one situation or the hand brake will produce a force which could destroy or severely damage the slack adjuster in the other extreme. The single actuator-slack adjuster of the aforementioned application provides a solution to these problems.

The packing cup of the piston of the single actuator must be changed approximately every five years. Where a single actuator is used for truck mounted brakes, the cylinder housing for the piston is usually connected at both ends between the actuator system for the brake beams and the brake beam itself. Thus, to obtain access to the packing cup, the actuator has to be removed from the brake beam or truck. This involves a substantial amount of time in removing the actuator in addition to replacement of the cup.

Since the actuator generally includes a spring biasing the piston to a released position, dismantling of the cylinder housing for the piston is tricky. Replacement of the packing cup is also more difficult when the actuator piston is also integral with the housing for the slack adjuster. The interrelationship of the slack adjuster to the piston must be taken into account. Also, the actuator is generally positioned between a brake beam and the axle. This limits the space or clearance available between the brake beam and axle to maneuver the actuator or portions thereof for removal and replacement.

Thus, it is an object of the present invention to provide a method for replacing the packing cup of an actuator without removing the actuator from the brake beam or truck.

Another object of the present invention is to provide a unitary slack adjuster and actuator which is capable of having its packing cup replaced while mounted to a brake beam or truck.

These and other objects are achieved by moving a piston and a force transmitting element connected to the piston by a slack adjuster to a locking position. The piston and force transmission elements are locked in the locking position which preferably is displaced from the brake released position. This increases the spacing between the piston and an adjacent axle. A portion of the cylinder surrounding the piston is removed from the housing which is connected to the brake beam or truck and the packing cup is replaced. The cylinder portion is then replaced on the housing and the piston force transmission elements are unlocked and the piston force transmission are allowed to return to their released position.

The piston and force transmission elements are removed from their brake released position towards the brake applied position so as not to activate the slack adjuster during this movement. As an initial step prior to moving the piston slack adjuster element from the released position towards the brake applied position, the slack adjuster is actuated to shorten its length. This allows the subsequent moving step to have its maximum length of travel without applying the brakes and increases the distance between the brake beam and the axle.

In a first embodiment, the piston is locked to the housing. The piston includes a rod sliding in a bore in the housing and the rod to the housing. The rod includes a transverse slot and the housing includes an aperture intersecting the bore. A detent pin is inserted through the aperture and into the slot when they are aligned in the locking position so as to lock the pin to the housing. As an alternative to the transverse slot in the rod, the aperture that intersects the bore of the rod is threaded and a set screw in the thread aperture would engage the rod and lock the piston to the housing.

An improved integral brake actuator/slack adjuster unit includes the slot in the rod of the piston and the aperture intersecting the bore so that they can be used with the detent pin or a threaded aperture and set screw.

In the second embodiment of the present method, the force transmission element is locked to the truck, or a second brake beam. This includes inserting a block between a lever mounted to a second beam and connected to the force transmission element and the second brake beam to hold the force transmission element and the connected piston displaced from the brake released positions and locked in a first direction. In this embodiment, the force transmission element is again moved towards its brake applied position during unlocking to allow removing of the block. It should also be noted that the block defines the locking position for the first embodiment using the detent pin or screw and may be used in combination therewith to lock the piston and the force transmission elect.

Other objects, advantages and novel features of the present invention will become apparent from the following detailed description of the invention when considered in conjunction with the accompanying drawings.

DESCRIPTION OF THE PREFERRED EMBODIMENT

Figure 1:
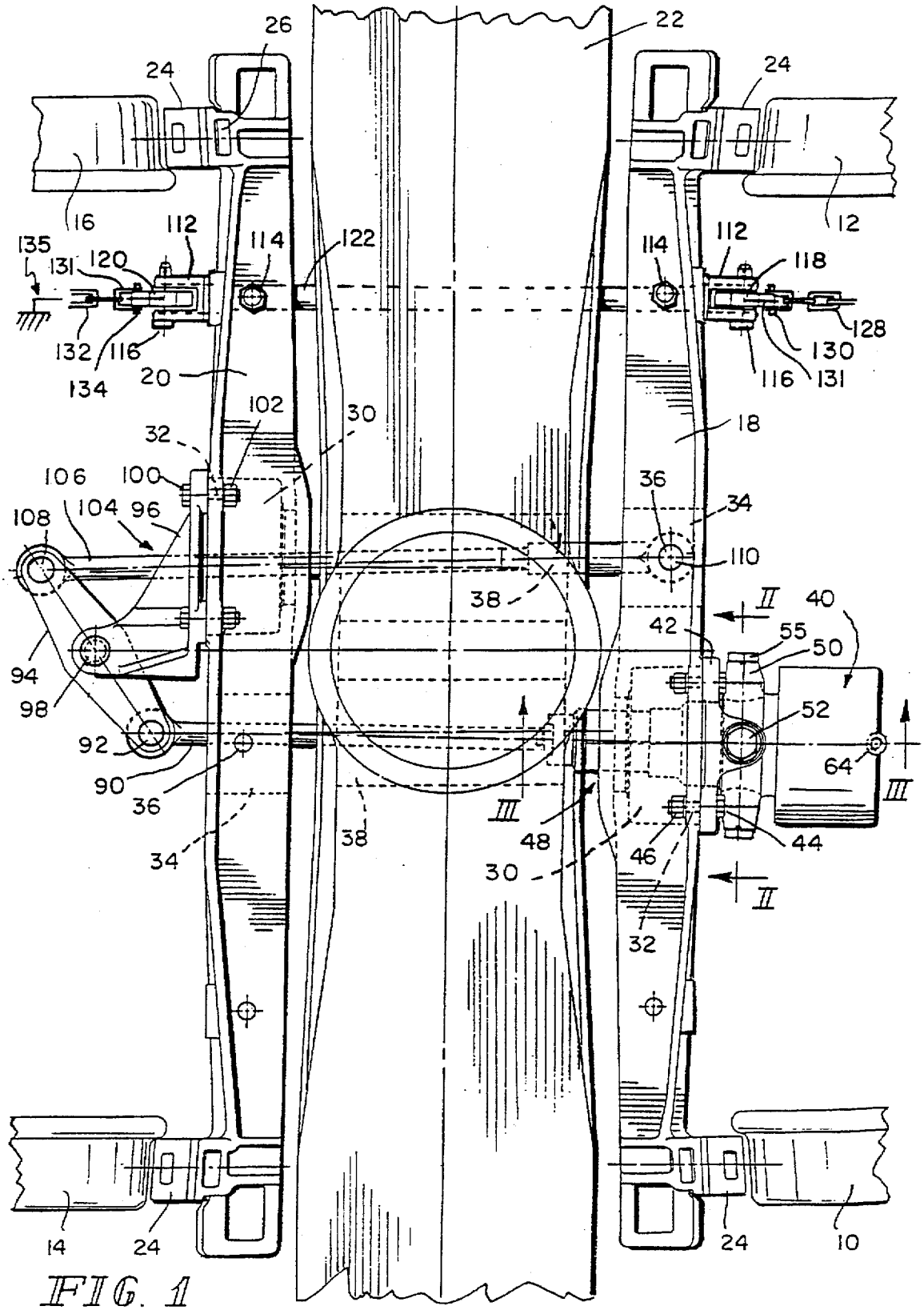
FIG. 1 is a plan view of a brake system incorporating the principles of the present invention.

A brake system for a railroad vehicle is illustrated in FIG. 1. Although the description of the system will be provided with respect to conversion of existing dual actuator, truck mounted brake systems, the present mounting structure of the single actuator is also applicable to any other truck mounted brake system or any other brake system. The existing structure of the dual actuator, brake mounted system will be described first and will be followed by the specific elements of the present system which is mounted thereto. Two pairs of wheels 10/12 and 14/16 are secured to opposites ends of a respective axle, not shown for sake of clarity, of a two-axle, four wheel railroad car truck. A pair of brake beams 18 and 20 extend crosswise of the car truck and parallel to each other and to a truck bolster 22. Brake shoes 24 are mounted to the brake head 26 at each end of the brake beams 18 and 20. The brake beams 18 and 20 have a generally U-shaped cross section. Beams have casted passage holes 30, 34 and mounting surfaces with holes 32. A pair of opposed mounting holes 36 on the top and bottom portion of the beams are used to mount the push rod 106. The bolster 22 has a pair of channels 38 on each side of the center axis.

Double acting brake cylinder is mounted on one of the beams with a force transmitting element or push rod 90 extending through channels 38 in the bolster 22 and connected to opposed beam through transfer lever 94. The present brake system includes a brake actuator or cylinder 40 mounted to the brake beam 18 by a bracket 42 and an intermediate gimbal or cage 50. Bolts 44 extend through the elongated openings 43 (FIG. 2) in the bracket 42 and the mounting holes 32 in the brake beam 18 and is secured thereto by nuts 46. The cylinder 40 has double acting internal slack adjuster 48 increasing or decreasing cylinder length automatically. The slack adjuster will be discussed in detail with respect to FIGS. 3 and 4.

Figure 2:
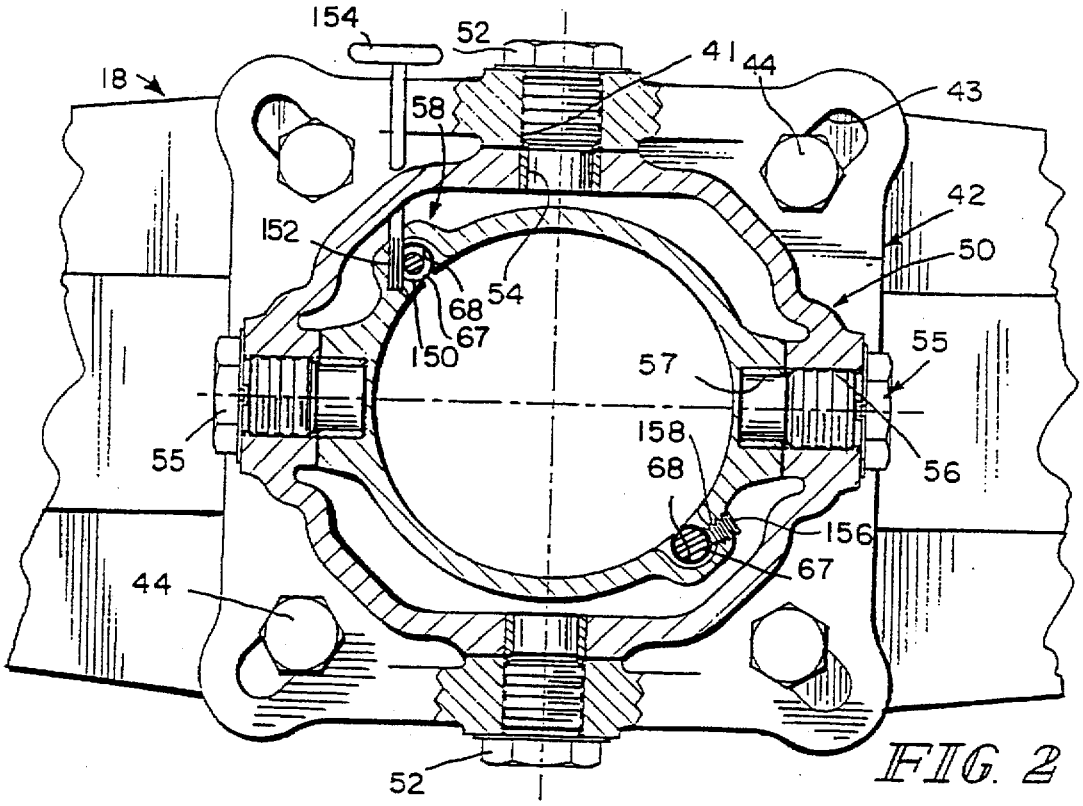
FIG. 2 is a cross sectional view of the mounting of the actuator to the brake beam taken along lines II—II of FIG. 1 with the details of the actuator deleted and the addition of a detent pin and screw according to a first embodiment of the present invention.

The gimbal 50 mounts the actuator brake cylinder 40 to the brake beam 18 through bracket 42 so that it freely rotates horizontally and vertically which results in high and consistent efficiency. As illustrated in FIG. 2, the gimbal 50 is mounted to the bracket 42 by fasteners 52 which are threadably received in aperture 41 of the bracket 42 and extend into a sleeve bearing 54 in the gimbal 50. A non-pressurized cylinder portion or head 58 is mounted to the gimbal 50 by a fastener 55 threadably received in a bore 56 of the gimbal 50 and having an end extending into bearing sleeve 57 in the cylinder portion 58.

Figure 3:
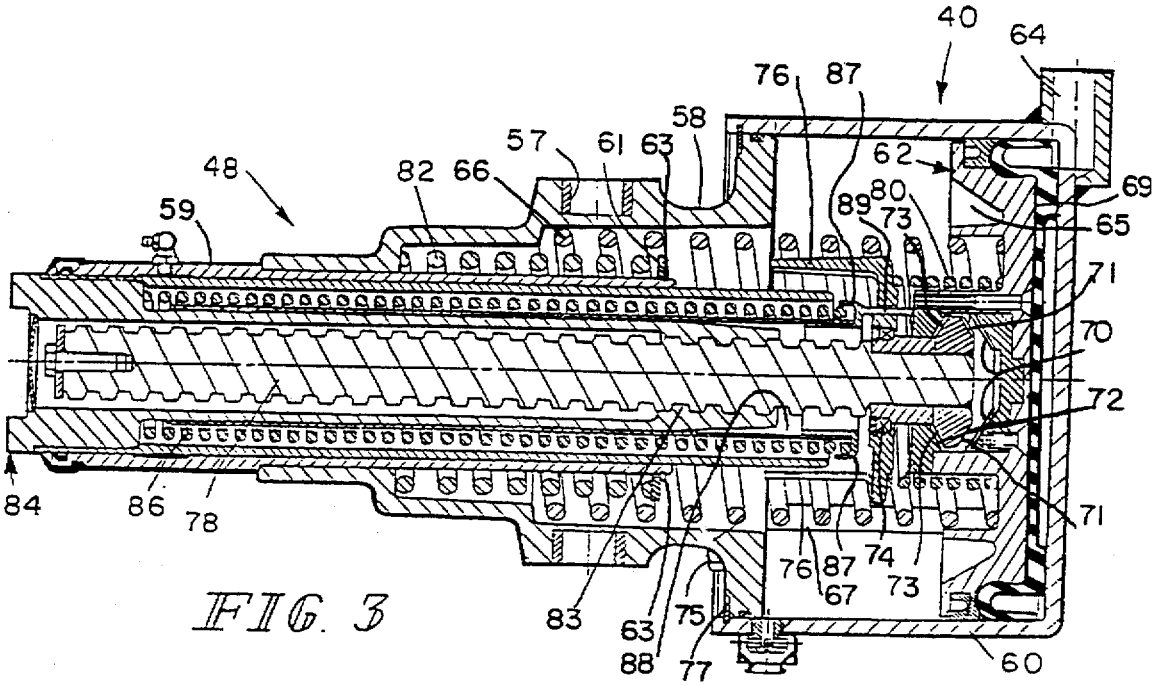
FIG. 3 is a cross sectional view of the actuator with slack adjuster in a released position taken along lines III—III of FIG. 1.

As illustrated in FIG. 3, the brake cylinder actuator 40 includes a body or first cylinder portion 60 and non-pressure head or second cylinder portion 58 to form a housing. The first cylinder portion 60 is secured to head 58 by retaining ring 77, and the head 58 is mounted to the gimbal 50. Piston 62 divides the interior of body 60 into a pressurized and unpressurized volumes. A port 64 admits the fluid pressure into the volume between the body 60 and the piston 62 to move the piston 62 to the left in brake applied position. Spring return 66 resting at one of its ends on the cylinder portion 58 and biases the piston 62 to the right. A pair of anti-rotation rods 67 extend from the piston 62 and are slidably received in bores 68 in the head 58, as illustrated in FIGS. 2 and 3. The piston includes a packing cup 69 mounted thereto.

The cylinder slack adjuster portion 48 includes a back female clutch face 70 and a front female clutch face 72 both mounted to the piston 62 cooperating with a corresponding back head clutch face 71 and front head clutch face 73 both part of the compensator screw 78. To address the problem of pulling force applied to the output of the slack adjuster by a hand brake application, the front clutch faces 72,73 form a friction clutch while the back clutch faces 70,71 form a toothed clutch.

A bearing 74 rotationally mounts the screw 78 to a bearing cup 76. A cup spring 80 rests between the piston 62 and the bearing cup 76 and biases the front clutch faces 72,73 into engagement to prevent rotation of the screw 78. A spring 82 rest between the actuator internal housing portion 58 and a ring 61 slidable on sleeve 59 mounted to the housing portion 58 and retaining ring 63 on sleeve 59. The spring 82 is stronger than cup spring 80 so as to cause bearing cup 76 and the screw 78 and clutch faces 72,73 to stop moving to the left in FIG. 3 for continued leftward movent of the piston 62. This will cause clutch faces 72, 73 to disengage and allow rotation of the screw 78 until further travel to the left of the piston 62 relative to the cup 76 is terminated by the engagement of back clutch faces 70, 71.

A ram 84 is guided inside of the sleeve 59 and is threadably connected to the compensation screw 78 at threads 83. A ram spring 86 extends between the ram 84 and a flange 87 on sleeve 88 which engages the piston by follower 89 extending through bearing cup 76 holes. Spring 86 pushes ram 84 leftward when screw 78 rotates during the excessive slack. The slack adjuster 48 is a double acting slack adjuster integral with the actuator 40 or brake cylinder.

A first force transmission element or push rod 90 extends from the cylinder slack adjuster 48 at ram portion 84 through the channel 38 in the bolster 22 and the passage hole 34 in the second brake beam 20. The rod 90 is connected at its other end by pin 92 to the left side of transfer levers 94. A pin 98 pivotally mounts the transfer levers 94 to a bracket 96 which is connected to the brake beam 20 by fasteners 100 extending through the mounting holes 32 and nuts 102. The bracket 96 has the passage hole 104, not shown, which aligns with the actuator passage 30 in the beam 20. A second force transmitting element or rod 106 has its first end connected to the right side of the transfer levers 94 by a pin 108. The force transmitting rod 106 extends through the aligned passage 104 in bracket 96 and the passage 30 in brake beam 20, through channel 38 in the bolster 22 and into the passage hole 34 of the first brake beam 18. A pin 110 extends through the pre-existing mounting hole 36 in the beam 18 to connect the other end of rod 106 to the first brake beam 18.

The gimbal 50 and its connection to the first brake beam 18 allows the actuator 40 to freely maintain its axis of force application coaxial with the axis of the first force transmitting element or rod 90. This prevents twisting and bending of the ram 84 during the arc movement of levers 94 (horizontal movement) and brake beams (18, 20) movement in the side frame pockets up and down (vertical movement). Although the bracket 42 has been shown to be mounted to the preexisting mounting holes for a dual actuator beam system, it can be mounted to any brake beam as well as to brake beams which are not truck mounted.

The hand brake illustrated in FIG. 1 includes a fulcrum bracket 112 mounted to each of the brake beams 18 and 20 by beam pin 114. Lever 118 and 120 are mounted to the fulcrum bracket 112 of beams 18 and 20 respectfully by fulcrum pin 116. A push rod 122 is interconnected to the lower end of the levers 118 and 120 by push rod pins, not shown. Cotter pin 126 retains the push rod pins and the fulcrum pins 116 in place. A hand brake chain 128 through clevis 131 is connected to the upper end of lever 118 by pin 130. A chain 132 is similarly connected to the upper end of lever 120 by a pin 134. The other side of the chain 132 is connected to the car body 135. The pulling force on chain 128 rotates the lever 118 transmitting force by rod 122 to separate the brake beams 18 and 20. This force separating the brake beams 18 and 20 is transmitted back through the brake actuation system as a pulling input through bracket 96, rod 106, levers 94 and rod 90. Although the hand brake directly applies the brakes through the brake beams, the pulling force on the cylinder slack adjuster determines the ram extension 84 relative to the actuator 40 as needed.

Figure 4:
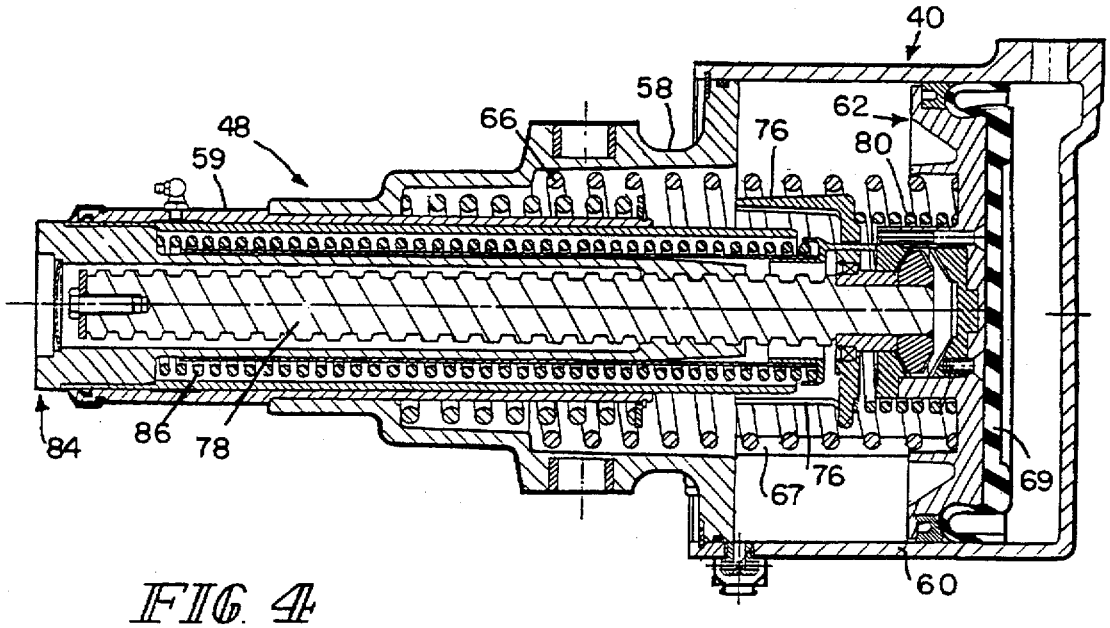
FIG. 4 is a cross sectional view of the actuator with slack adjuster in a partial brake applying position.

The slack adjuster in its released or non-brake position is illustrated in FIG. 3 with the front clutch 72, 73 engaged and back clutch 70, 71 disengaged. When air is applied to the cylinder through port 64, the piston 62 and the whole internal mechanism moves to the left as shown in FIG. 4. The front clutch 72, 73 remains locked by the force of cup spring 80. Movement of the screw 78 is stopped by the bearing cup 76, ring 61 and spring 82. If excess slack remains or exists, piston 62 continues to move to the left against spring 82, causing front clutch 72 and 73 to disengage and allowing the screw 78 to rotate. This allows spring 86 to move the ram 84 forward until the brake shoes 24 contact the wheels. Piston 62 continues moving to the left until the back clutch 70 and 71 is locked. The cylinder starts to buildup braking force with the back clutch 70, 71 locked.

When the brakes are to be released, fluid at port 64 is evacuated and the return spring 66 moves the piston 62 to the right with the whole internal mechanism. The back clutch 70, 71 disengaged when bearing cup 76 moves right and the force of the spring 80 overcomes force of the spring 82. Piston 62 still moves to the right increasing the clearance between the cup bearing 76 and ring 61. The force of the spring 80 moves the screw 78 and ram 84 to the left-locking the front frictional clutch 72, 73 and preventing the screw 78 from rotating.

By mounting the brake actuator to the truck or brake beam by the non-pressure cylindrical portion 58, and connecting the combined actuator and brake beam to the brake system only through ram 84, the cylinder portion 60 may be removed without removing the actuator 40 from the brake beam or truck. Since the cylinder portion 60 acts as a stop for the piston 62, the forces of the piston spring 66 and the ram spring 86 are transferred through the piston 62 to the cylinder portion 60. Some means must be provided to lock the piston 62. Preferably, the piston is locked in a position displaced from its released position illustrated in FIG. 3 and preferably that in FIG. 4. This prevents any damage to the packing cup 69 during reassembly of the cylinder portion 60 to the cylinder portion 58.

Also, by moving the piston 62 closer to the brake beam 18, the piston 62 is further from the axle of wheels 10 and 12. Although the brake beam moves towards the axle for this displacement of the piston, it is only a percentage of the piston movement and thus, there is an overall net increase in spacing between the piston and axle. This reduces the distance the cylinder portion 60 must move away from the brake beam 18 and toward the axle of wheels 10, 12.

A first embodiment of a lock involves locking the piston 62 to the cylinder portion 58. As illustrated in FIG. 2, one of the anti-rotational rods 67 has been machined with a ring groove or transverse slot 150. Also, the non-pressurized cylinder portion 58 of the housing has an aperture 152 machined therein intersecting the bore 68 in which the anti-rotation rod 67 slides. A dent pin 154 is inserted through aperture 152 into slot 150 when they are aligned to define the locking position. This maintains the piston 62 fixed with respect to the cylinder portion 58 and as will be described below, allows removal of the cylinder portion 60 without any adverse affects on the piston and slack adjuster elements remaining.

Preferably, the position of the slot 150 is such that it aligns with the aperture 152 when the piston is in the position illustrated in FIG. 4 displaced from the released position illustrated in FIG. 3. More than one slot may be provided in the anti-rotation rod 67 and both the rods may be appropriately machined. It should also be noted that the aperture 152 is in the non-pressurized cylinder portion 58 and therefore no sealing or other provisions need to be provided. The aperture 152 should not be totally through the cylinder portion 58, otherwise it will interfere with the spring 66 and other mechanical elements.

The process for changing a packing cup 69 and piston 62 preferably includes moving the piston 62 and its force transmission system from the brake released position illustrated in FIGS. 1 and 3 towards the brake applied position to a locking position. The piston 62 and the force transmission elements are locked in the locking position displaced from the brake released position. For the embodiment illustrated in FIG. 2, this locking position is in FIG. 4 wherein the slot 150 on anti-rotational pin 67 aligns with aperture 152. The detent pin 154 is inserted into aperture 152 through slot 150. The first cylinder portion 60 is then removed by removing bolt 75 and retainer ring 77. Since the piston 62 and the force transmission system are locked, all of the springs and biasing elements are held between the piston 62 and the remainder of the cylinder housing 58.

Preferably, the movement of the piston does not disengage the clutch faces 73 and 72 such that the slack adjuster is not activated nor place the return springs under significant forces. It should also be noted that the piston 62 may be moved by applying a fluid to the pressurized side of piston 62 through port 64 or the hand brake may be actuated pulling the force transmission system so as to move the piston 62 from its released position in FIGS. 1 and 3 towards the brake partially applied position to the locking position.

To aid in positioning the piston in the locking position, a block 140, as described below with respect to FIG. 5, may be placed between one arm of the lever 94 and the second brake beam 20. The thickness of block 140 aligns the slot 150 on the anti-rotational pin 67 with the aperture 152. Either fluid pressure is applied to the piston or manual force to the force transmission system to move the piston and the force transmission system to allow the positioning of the block 140 between the lever 94 and the brake beam 20. Once this pressure is released, the block 140 will define the locked position for the piston and allow insertion of the detent pin 154 into aperture 152 and slot 150. As a typical example, the block 140 may have a thickness of approximately three inches.

The removal of the cylinder portion 60 allows access to the packing cup 69 and the piston 62. The packing cup is then removed and a new packing cup is mounted to piston 62. The cylinder portion 60 is then remounted to the cylinder portion 58 by bolt 75 and retainer ring 77. The piston 62 and the force transmission systems are then unlocked. In the embodiment of FIG. 2, the detent pin 154 is removed allowing the anti-rotational rods 68 to freely move under the influence of the biasing springs. This biases the piston 62 back against the end phase of the cylinder portion 60.

As an alternative to the detent pin 154 and the specially positioned slot 150 on the anti-rotation rod 68, the piston can be locked in any position by a set screw 156 received in threaded aperture 158 of the cylinder portion 58. Set screw engages the anti-rotation rod 68 and then holds the piston 62 fixed with respect to the cylinder portion 58. The set screw may be used in combination with the detent pin 154 or by itself.

As an alternative to locking the piston 62 directly, the transmission system may also be locked in the partially applied position or positions displaced from the released position of FIGS. 1 and 3. As illustrated in FIG. 5, the force transmission system may be locked in one direction to the brake beam or truck by the locking block 140. The piston 62 and the force transmission system are moved from the brake released position of FIGS. 1 and 3 to the partially brake applied position of FIGS. 4 and 5. The transfer lever 94 and the connection point 92 between the lever 94 and the force transmission element or push rod 90 moves away from the brake beam 20 in the position illustrated in FIG. 1 to that of FIG. 5.

The block 140 can then be provided between an arm of the lever 94 and the brake beam 20 to define the locked position and lock the force transmission system in one direction. Block 140 may be used by itself, but preferably the block 140 is used in combination with one of the first embodiment detent pins or screws which lock the piston to the housing. The moving force applied to move the piston 62 and the force transmission system from the brake released position towards the brake applied position can then be released. The forces of the spring 62 and 86 are then absorbed by the block 140. A second block may be provided between the other arm of the lever 94 and the bracket 96 to lock the force transmission in a second direction opposite the first direction locked by block 140. It should be noted that block 140 is configured so as to extend around the force transmission element 90 and may either rest on one side, or include a slot to receive the force transmission elements.

The disassembly of the cylinder and replacement of the packing cup can then proceed as described above. As in the discussion of the previous embodiment, the movement of the piston must be such that the slack adjuster not be actuated.

To remove the safety block 140, after reassembly of the cylinder, the cylinder and the force transmission system is moved again towards the brake applying position so as to relieve pressure from the block 140. This may be by applying pressure to port 64 and the pressurized phase of piston 62 or again applying mechanical force to the force application system. Once the block 140 is removed, the pressure or mechanical force may be relieved allowing the springs to return the piston 62 and the force transmission system to the released position illustrated in FIGS. 1 and 3.

Figure 5:
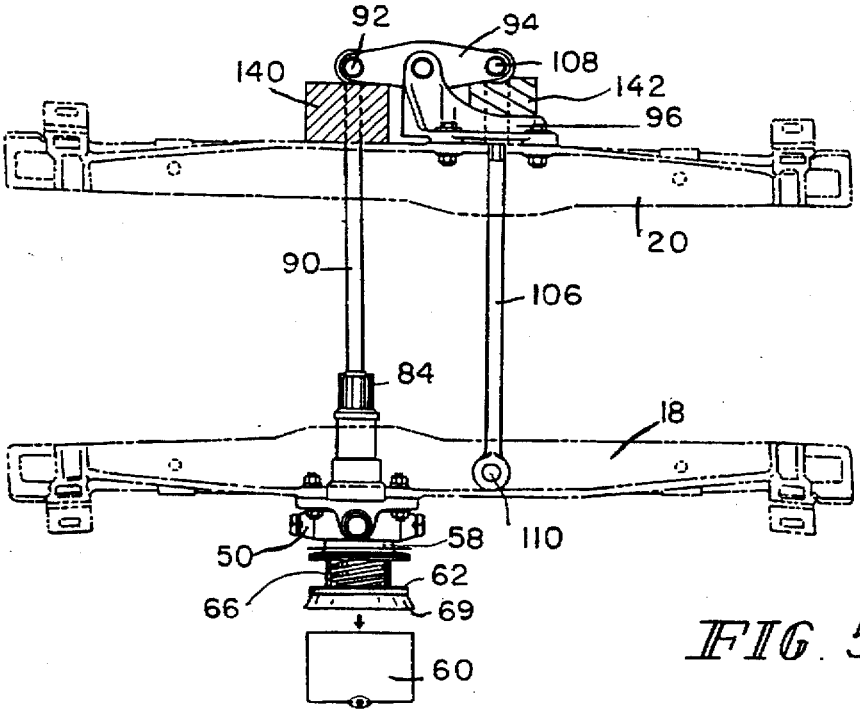
FIG. 5 is a plan view of the brake system of FIG. 1 illustrating the second embodiment of the method of the present invention.

Since the slack adjuster system is not to be actuated during the movement from the brake released position to the lock position of FIGS. 2, 4 and 5, the brake shoes must not come into contact with the wheels in the predetermined lock position. To assure that this does not occur, it is necessary to assure that the ram 84 is in its fully retracted or shortest length. To accomplish this, the ram must be retracted or collapsed into the cylinder with the brake in the released position of FIGS. 1 and 3. This is accomplished by prying the brake heads or beams 118 or 120 from the wheels using a pry bar. This increases the clearance between the actuator and force transmission system of the wheels. Thus, when the piston 62 and the force transmission is moved from its released position of FIGS. 1 and 3, to the lock positions of FIG. 2, 4 and 5, the brakes will not engage the wheels.

With new brake equipment, the use of either the detent pin 154 or the block 140 is generally sufficient to retain the position of the piston and the force transmission system during the removal of the cylinder portion 60. In actual field conditions, it has been found that it is very difficult to move the piston 62 without actuating the slack adjuster and thereby decreasing the distance between the piston and the axle. The cylinder portion 60 is very hard to remove and the wiggling, twisting and forces applied to remove the cylinder portion 60 has actuated the slack adjusting mechanism which moves the brake beam 18 closer to the adjacent axle. This makes it very difficult to remove the cylinder portion 60 because there is not sufficient clearance between the piston 62 and the axle. To prevent this from recurring in the field, it is preferred that the detent pin 154 or set screw 156 embodiment be used in combination with one or both of blocks. This not only locks the piston with respect to the brake beam 18, but also prevents the slack adjuster from operating to adjust the force transmission system and move the brake beam 18 closer to the axle adjacent the piston.

Although the detent pin 154 and screw 156 and the block 140 are two embodiments for locking the piston and the force transmission system, other mechanisms may be used. Also, although it is not preferred, the force transmission system and the piston may be locked in their released position. This will make it more difficult to reassemble the piston 60.

It should be noted that a single actuator modified to include the slot 67 on the anti-rotational pin and apertures 152 and 158 on the cylinder portion 158 is a unique actuator which is usable in the present method.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A method of changing a packing cup on a piston in a cylinder of an integral brake actuator-slack adjuster unit, a housing of the unit being mounted on a brake beam or truck, a brake force transmission element being connected to said piston by a slack adjuster and extending from said unit, the piston and force transmission element having a brake released position and a brake applied position, a first portion of the cylinder being removable from the housing, the method comprising the following steps performed with the unit mounted to the brake beam or truck:

moving said piston and said force transmission element to a locking position;

locking said piston and said force transmission element in said locking position;

removing said first cylinder portion from said housing;

replacing said packing cup;

replacing said first cylinder portion on said housing; and unlocking said piston and said force transmission element.

2. A method according to claim 1, wherein said piston and said force transmission element are moved from said brake released position towards said brake applied position to said locking position displaced from said released position.

3. A method according to claim 2, wherein said piston and said force transmission element are moved from said brake released position toward said brake applied position so as to not activate said slack adjuster.

4. A method according to claim 2, including prior to moving said piston and said force transmission element from said brake released position toward said brake applied position, activating said slack adjuster to shorten its length.

5. A method according to claim 1, wherein said locking includes locking said force transmission element to the brake beam or said truck.

6. A method according to claim 5, wherein said force transmission element extends through a second brake beam and is connected to a lever mounted to said second brake beam; and said locking includes positioning a block between said lever and said second brake beam to lock said force transmission element to said second beam in a first direction.

7. A method according to claim 6, wherein unlocking includes moving said force transmission element towards said brake applied position and removing said block.

8. A method according to claim 1, wherein said locking includes locking said piston to said housing.

9. A method according to claim 8, wherein said piston includes a rod slidably received in a bore in said housing; and said locking includes locking said rod to said housing.

10. A method according to claim 9, wherein said rod includes a transverse slot; said housing includes an aperture intersecting said bore; and said locking includes inserting a pin through said aperture and into said slot when aligned.

11. A method according to claim 9, wherein said housing includes a threaded aperture intersecting said bore; and said locking includes threading a screw through said aperture and onto said rod.

12. A method according to claim 1, wherein said unit includes a spring between said housing and said piston and biasing said piston to its released position.

13. A method according to claim 1, wherein said locking includes locking said force transmission element to the brake beam or said truck and locking said piston to said housing.

14. A method according to claim 1, wherein:

said force transmission element extends through a second brake beam and is connected to a lever mounted to said second brake beam; and said moving includes moving said piston and said force transmission element from said brake released position past said locking position and inserting a spacer between said lever and said second brake beam to define said locking position and locking said force transmission element to said second brake beam in a first direction.

15. A method according to claim 14, wherein said locking includes locking said piston to said housing.

16. A method according to claim 15, wherein said locking includes locking said force transmission element to said second brake beam or said truck using said spacer.

17. An integral brake actuator-slack adjuster unit, comprising:

a housing to be mounted on a brake beam or truck;

a piston and packing cup on said piston sliding in a cylinder on said housing;

said piston having a brake released position and a brake applied position;

a first portion of the cylinder being removable from the housing;

a rod connected to said piston and slidably received in a bore in said housing;

an aperture in said housing intersecting said bore; and a lock to be inserted through said aperture and to said rod to lock said piston to said housing.

18. An integral brake actuator-slack adjuster unit according to claim 17 wherein said rod includes a transverse slot; and said lock includes a pin to be inserted through said aperture and into said slot when aligned to lock said piston to said housing.

19. An integral brake actuator-slack adjuster unit according to claim 18 wherein said aperture and slot are aligned when said piston is in a position displaced from said released position.

20. An integral brake actuator-slack adjuster unit according to claim 17 wherein said aperture is threaded; and said lock includes a screw to be threaded through said aperture and onto said rod to lock said piston to said housing.

21. An integrated brake adjuster unit according to claim 17, wherein said unit includes a brake force transmission element connected to said piston by a slack adjuster;

including a block to be positioned between an arm of a lever connected to said brake force transmission element and a second brake beam to which the lever is mounted, said block locking said brake force transmission element to said second brake beam.

* * * * *